US005653666A

United States Patent [19]

Pantoleon

[11] Patent Number: 5,653,666

[45] Date of Patent: Aug. 5, 1997

[54] NEGATIVE RESISTANCE WEIGHTLIFTING APPARATUS

[76] Inventor: James T. Pantoleon, 347 Lorimer St.-#3A, Brooklyn, N.Y. 11206

[21] Appl. No.: 523,341

[22] Filed: Sep. 5, 1995

[51] Int. Cl.[6] ..... A63B 21/00

[52] U.S. Cl. ..... 482/112; 482/111; 482/108

[58] Field of Search ..... 482/97, 108, 111, 482/112, 122, 104–106, 133, 142

[56] References Cited

U.S. PATENT DOCUMENTS

| | | |
|---|---|---|
| 4,050,310 | 9/1977 | Keiser . |
| 4,227,689 | 10/1980 | Keiser . |
| 4,253,662 | 3/1981 | Podolak . |
| 4,257,593 | 3/1981 | Keiser . |
| 4,540,171 | 9/1985 | Clark et al. . |
| 4,546,971 | 10/1985 | Raasoch . |
| 4,563,003 | 1/1986 | Bugallo et al. . |
| 4,765,611 | 8/1988 | MacMillan . |
| 4,846,466 | 7/1989 | Stima, III . |
| 5,011,142 | 4/1991 | Eckler . |
| 5,147,263 | 9/1992 | Mueller . |
| 5,151,072 | 9/1992 | Cone et al. . |

*Primary Examiner*—Jerome Donnelly
*Attorney, Agent, or Firm*—Harold James, Esq.; Robert L. Epstein, Esq.; James & Franklin

[57] ABSTRACT

A negative resistance weightlifting apparatus suitable for use with, among other things, a weight in the form of a separate barbell, in which means under the direct control of the user controllably produces a negative resistance effect by pressing down with an adjustable force on the weight as it is being lowered and preferably positively disengaging itself from the weight when the latter is being lifted, safety means being provided to adjustably limit the weight locations where such force can be applied and to automatically release the excess downward force when the weight has achieved a predetermined and adjustable lower position, all to produce weight lifting and lowering excercises of maximum efficiency and effectiveness while at the same time protecting the user against accidents and any unfortunate consequences arising from temporary physical weakening.

29 Claims, 4 Drawing Sheets

NEGATIVE RESISTANCE WEIGHTLIFTING APPARATUS

The present invention relates to weightlifting apparatus designed to produce an effective negative resistance when the weight is lowered and thus intensify the effectiveness of the exercise.

Weightlifting as a means of body building is well established. The user, by lifting and lowering a weight, often in the form of a conventional barbell, builds muscle, eliminates fat and otherwise achieves improved body condition. The efficacy of that type of exercise depends in large part on the degree to which the used muscles are challenged. If the challenge is too great, injury can result, the user will become discouraged, or both. If the challenge is insufficient the efficacy of the exercise leaves much to be desired. The weight which represents the optimum challenge will differ from individual to individual, and for a given individual may, and indeed should, differ with time, as the user's muscles grow with exercise. This is usually accomplished by adding to or subtracting from the weight being lifted.

It has long been recognized that a person is capable of lowering a greater weight than that which he is capable of lifting. Thus if the weight is optimum for being lifted by a particular individual in order properly to challenge his muscles, it will be less than optimum during the time that the user lowers the weight. The best situation is therefore one in which a greater weight is being lowered than is being lifted. The greater weight on lowering is known as "negative resistance", and many attempts have been made in the past to provide exercising apparatus which will produce such negative resistance. Clark Pat. No. 4,450,171 entitled "Variable Resistance Exercise Apparatus", MacMillan Pat. No. 4,765,611 entitled "Apparatus and Method For Weight Training Employing Counterweight", Stima Pat. No. 4,846,466 entitled "Microprocessor Controlled Electro-Hydraulic Exercise System", Eckler Pat. No. 5,011,142 entitled "Exercise Control System", Cone Pat. No. 5,151,072 entitled "Free Weight Barbell Spotting and Racking Machine", Mueller Pat. No. 5,147,263 entitled "Pneumatic Weight Lift Assist Apparatus", Bugallo Pat. No. 4,563,003 entitled "Weight Lifting Apparatus Having Increased Force On the Return Stroke", and Raasoch Pat. No. 4,546,971 entitled "Exercise Device" constitute prior art in this field.

A major problem involved in this type of apparatus, particularly when designed to be used in conjunction with a separate barbell, is ensuring that the exercising is performed safely, without injury to the user. Often users are overly optimistic as to their capabilities and exercise with weights too great for their ability. This can cause injury to muscles and, particularly when a barbell is employed, possible skeletal injuries if the lowering of the weight runs out of control. It is apparent that the possibility of injury to the user is greatly enhanced when, after he had lifted a heavy weight, the downward force of that weight, increased by negative resistance, may exceed his capability to resist, in which case he would be unable to restrain the downward movement of the barbell, with obvious harmful results. While it is up to the user not to use too great a lifted weight, it is up to the negative resistance apparatus to apply its negative resistance force in a controllable manner, as to time, duration, magnitude and nature of application, all preferably under the control of the user and preferably as he exercises, so as to achieve maximum safety and effectiveness.

It is also important, from a commercial point of view, that the apparatus be so designed as to be adjustable to the physique of the user. It is important in exercises of the type under discussion that the weight be lifted and lowered while the user's arms are within a relatively closely prescribed range of movement, since the angles that the upper and lower arms make with respect to one another and with respect to the torso significantly affect the strain placed on the muscles being used. A commercially satisfactory negative resistance apparatus should, therefore, be of standardized construction which is readily adjustable to fit the particular person using it at any given moment.

It therefore is a prime object of the present invention to devise an apparatus suitable for use in weightlifting in which negative resistance is provided during weight lowering by means under the control of the user. Preferably that control involves starting and stopping of the negative resistance under the user's control as well as automatic termination of the negative resistance at a lower limit of movement of the weight where continued application of the negative resistance may be physiologically undesirable.

A further object of the present invention is to provide a relatively inexpensive apparatus designed to function with a separate barbell and to produce the desired negative resistance as the barbell is moved from an upper to a lower position.

Another object of the present invention is to devise a negative resistance weightlifting apparatus consisting of a framework within which the user may position himself and then perform such lifting exercise as he desires, with or without the application of negative resistance, as the user chooses.

Yet another object of the present invention is to provide such an apparatus in which the time and degree of application of negative resistance can be adjusted or controlled so as to conform to the exercise requirements of the particular user.

To those ends, the negative resistance weightlifting apparatus of the present invention comprises a preferably skeletal framework within which an individual may position himself when he is exercising and in which, in the particular form here specifically disclosed, he exercises with a separate barbell to which weights appropriate for lifting are attached. The apparatus permits the weight such as the barbell to be lifted relatively freely, but the user is provided with controls such as hand switches so that, when the weight is raised as far as the user wishes to raise it, actuation of a switch will cause a pressure means such as a pneumatic cylinder-piston combination mounted on the framework to actuate a linkage which engages with the weight and pushes the weight down with a force which constitutes the desired negative resistance. When the weight has reached a predetermined lower position the pressure means is automatically de-activated, removing the negative resistance, and preferably is retracted to its initial position, permitting the free lifting of the weight. As an additional safety feature, the apparatus is provided with a positive stop which prevents exertion of the downwardly-acting negative resistance beyond a particular point whether or not the pressure means is deactivated by the user. The amount of negative resistance force exerted on the weight, the speed at which the weight can be lowered while the negative resistance continues to be applied to it and the speed at which the negative resistance linkage may be disengaged from the weight and permit the weight to be lifted without extra resistance are all adjustable to suit the requirements of the user.

To the accomplishment of the above, and to such objects as may hereinafter appear, the present invention relates to a negative resistance weightlifting apparatus as defined in the following claims and as described in this specification, taken together with the accompanying drawings, in which:

The apparatus of the present invention is here specifically disclosed in a form in which the weight being lifted is constituted by a conventional barbell consisting of a bar 2 to which weights 4 are secured, the barbell 2 being separate from the remainder of the apparatus, since such barbells are readily available and the ways in which they can be used for body building are well known, but the apparatus in its broader aspect need not necessarily utilize separate barbells, or, indeed, need not utilize barbells at all as the operative weight. The illustrated barbell 2 constitutes one embodiment of a weight means which is designed to be grasped and lifted by the user and, when being lifted, exert a predetermined force resisting that lifting.

Figure 4:
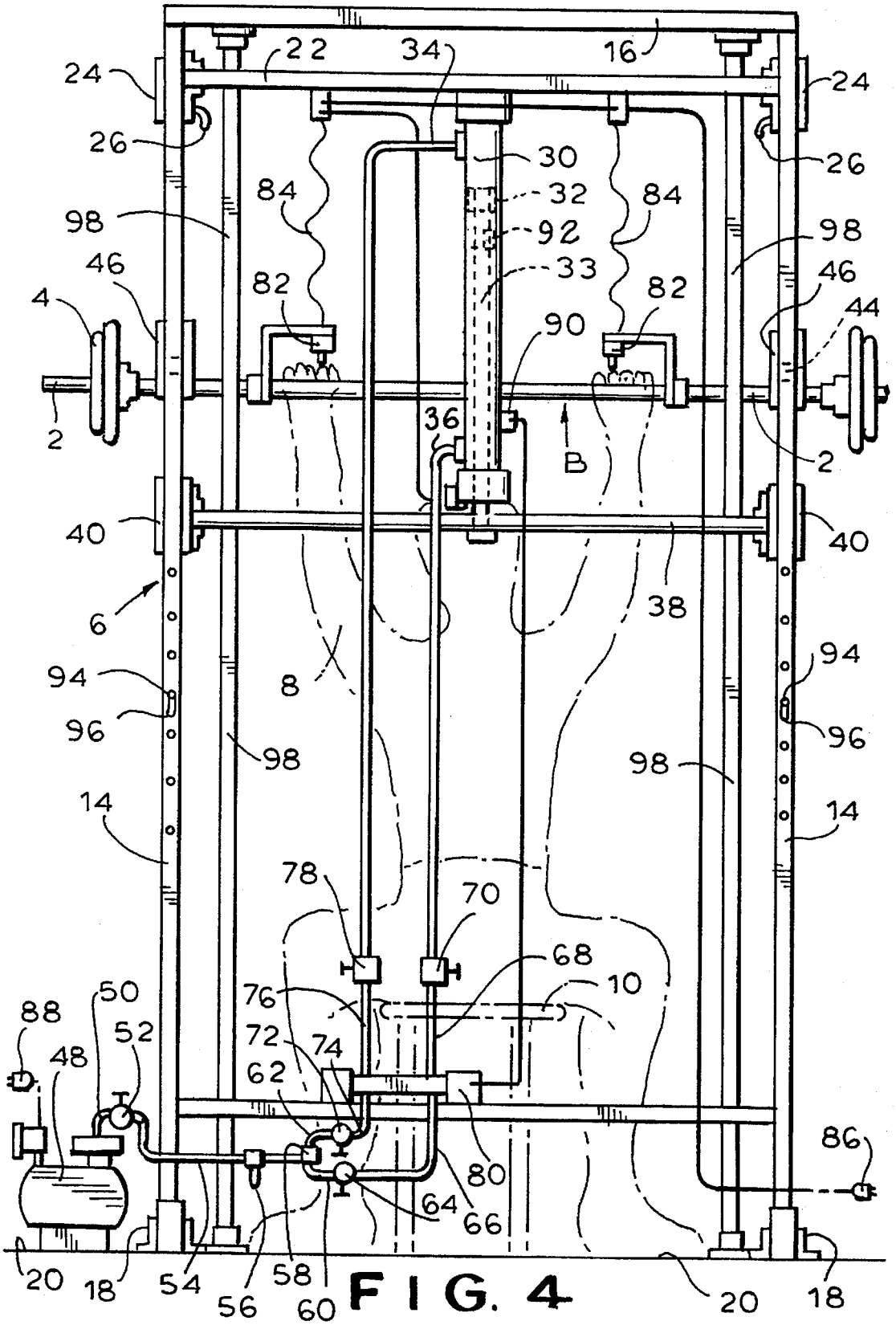
FIG. 4 is a rear view of the weight and apparatus corresponding to FIG. 2.

The apparatus which cooperates with the barbell 2 or other weight means comprises a framework generally designated 6 enclosing a space within which the user 8 may position himself in an appropriate position, a sitting position with the user 8 sitting on a stool or bench 10 being here illustrated by way of exemplification. That framework 6, in the form here specifically disclosed, comprises a pair of laterally spaced front uprights 12 and a pair of correspondingly laterally spaced rear uprights 14 connected together in some appropriate manner, as by means of the top structure 16 attached to the upper ends of the uprights 12 and 14, the lower ends of the uprights 12 and 14 being provided with enlargements or feet 18 adapted to engage a floor 20 or the like. A bar 22 extends between the rear uprights 14 and is mounted on those uprights by sleeves 24 slidable along the rear uprights 14 so that the bar 22 is adjustably vertically positionable and is secured in the desired vertical position by means of pins 26 which pass through the sleeves 24 and through the appropriate one of a plurality of passages 28 extending through the uprights 14. Mounted on and extending down from the bar, as may best be seen from FIG. 4, is a preferably pneumatic cylinder 30 having a piston 32 slidable therein and with a piston rod 33 extending downwardly therefrom, the cylinder-piston combination 30, 32 being of conventional nature in which the feeding of fluid under pressure through conduits 34 and 36 respectively controls the vertical location of the piston 32 within the cylinder 30. The exposed downwardly extending end of the piston rod 33 is secured to a clamp bar 38 which extends between the rear uprights 14 and is mounted thereon by means of sleeves 40 so as to be freely vertically slidable therealong. Secured to each end of the clamp bar 38 are L-shaped connecting links 42 which in turn are connected to crossbars 44 which extend between each pair of front and rear uprights 12, 14 and are mounted for free vertical slidable movement along those uprights by means of sleeves 46. Thus the crossbars 44, connecting links 42 and the clamp bar 38 comprise a rigid structure movable with the piston rod 33.

Mounted on the floor 20 adjacent the framework 6 is a fluid pressure source 48 which may take the form of an electric motor-driven air compressor, the air under pressure being fed through line 50 and adjustable pressure regulator 52 to line 54, air filter 56 and T-connection 58 leading to lines 60 and 62. Line 60 communicates with adjustable pressure regulator 64, lines 66 and 68, adjustable flow valve 70 and line 36. Line 62 communicates with adjustable pressure regulator 72, line 74, line 76, adjustable flow valve 78 and line 34. Interposed between lines 66 and 68 and between lines 74 and 76 is an electrically actuated double solenoid valve 80 effective to control the connection of line 68 to line 66 or to exhaust and the connection of line 76 to line 74 or to exhaust. The solenoid valve 80 is electrically controlled by a standard electrical circuit which includes switches 82 here shown as mounted on the bar 2 of the barbell at locations where the hands of the user will be when the barbell is grasped and lifted by him, those switches 82 preferably being individually effectively connected to the solenoid valve 80 by an appropriate electrical circuit including the extensible electric leads 84, electrical energy for the solenoid circuit being derived from the plug 86 which, like the plug 88 connected to the motor-driven air compressor 48, is adapted to be plugged into any suitable source of electrical energy.

Figure 3:
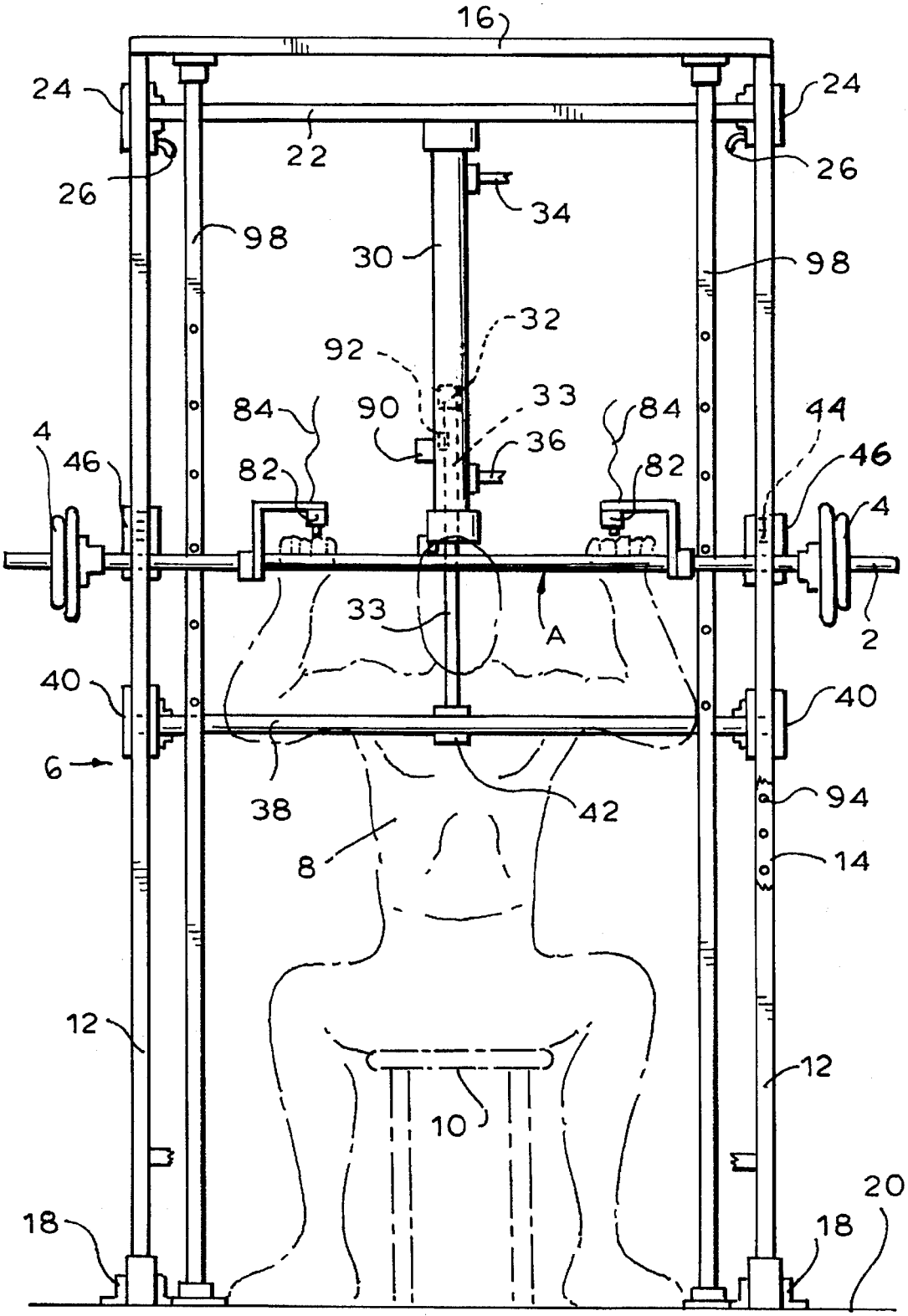
FIG. 3 is a view similar to FIG. 2 but showing the weight and associated apparatus in a lower position.

When neither of the switches 82 is actuated by the user of the apparatus the pressure line 66 will be connected to the pressure line 68 while the pressure line 76 is connected to exhaust. This will cause the piston 32 to rise within cylinder 30, lifting the crossbars 44 to a position well above the barbell when that barbell is in a lower position A such as is illustrated in solid lines in FIG. 3. The user can then lift the barbell in conventional fashion and that lifting will be resisted to a degree determined by the weights 4 then forming a part of the barbell. This is the conventional lifting stroke of the exercise, which the apparatus does not affect.

Figure 1:
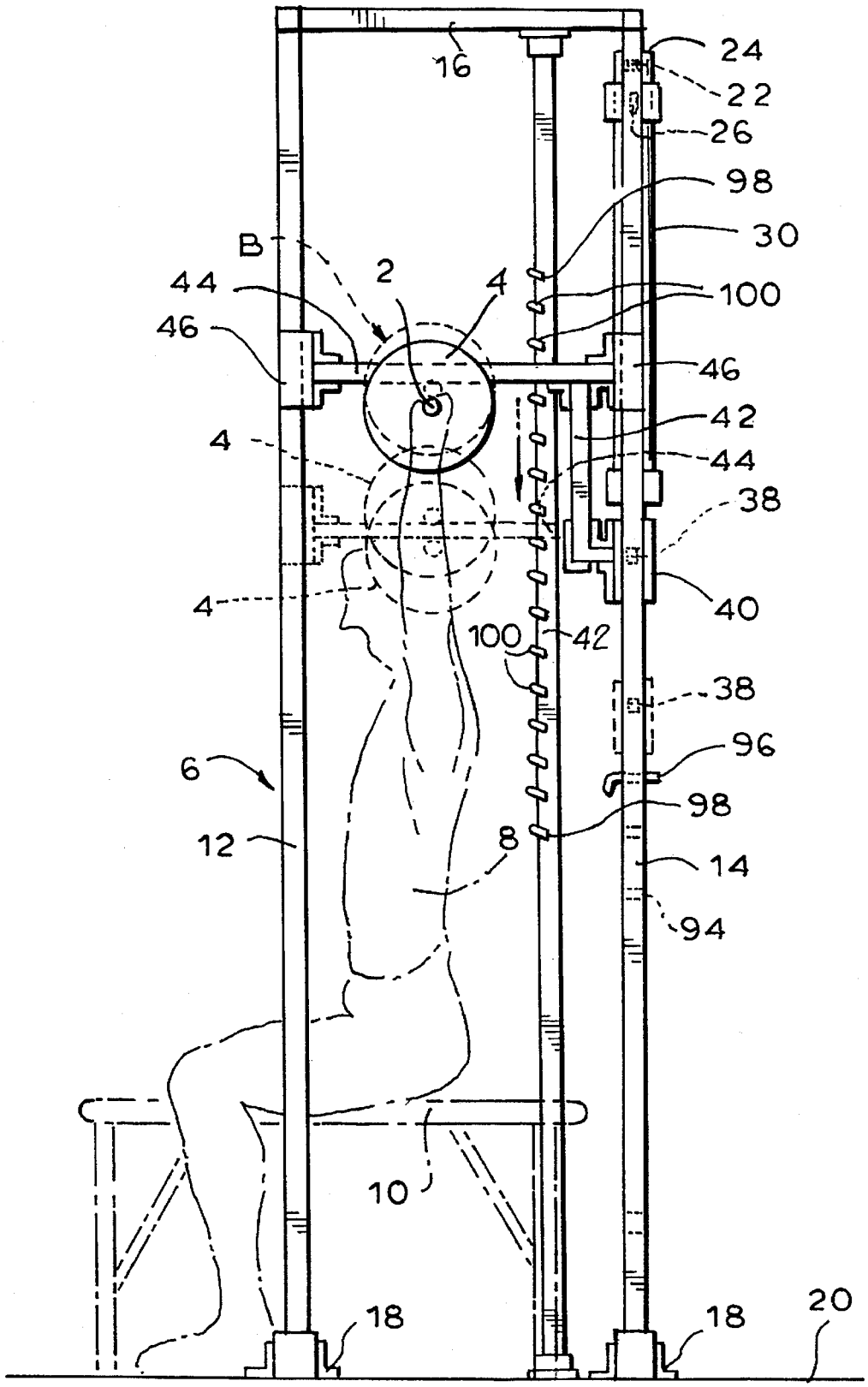
FIG. 1 is a side elevational view of the apparatus of the present invention with the barbell weight and operative parts of the apparatus being shown in solid lines at an elevated position and in broken lines at other positions.
Figure 2:
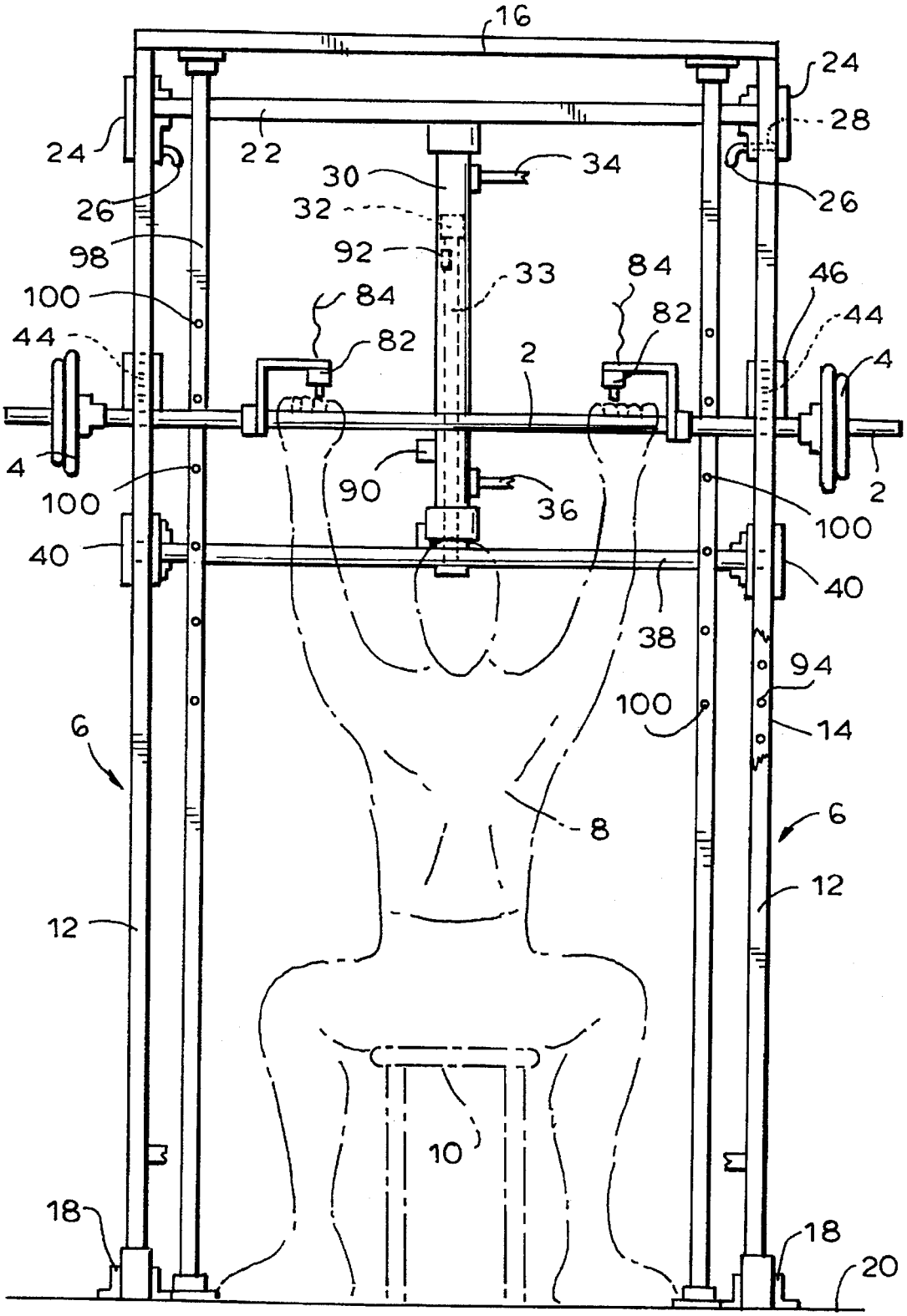
FIG. 2 is a front elevational view of the apparatus of FIG. 1.

The stationary bar 22 will be preferably so positioned that when the user has lifted the barbell to the desired maximum degree, as represented by the broken line B of FIG. 1, the bar 2 of that barbell will just touch the crossbars 44 because, as can be seen from the illustrations, the barbell is longer than the framework 6 is wide, so that portions of the bar 2 extend through the spaces between each pair of front and rear uprights 12, 14 and thus extend under the crossbars 44.

At this point the user, if he wishes to take advantage of negative resistance during the lowering of the barbell, will actuate a switch 82 to cause the solenoid valve 80 to connect the line 68 to exhaust and to connect the line 76 to the line 74, and as a result the pressure exerted on the upper surface of the piston 32 will force that piston downward within the cylinder 30, causing the piston rod 33, and with it the crossbars 44, to be similarly forced downwardly, thereby to exert a downward pressure on the bar 2 of the barbell to produce the desired negative resistance. The magnitude of that negative resistance can be adjusted by regulator 72. Additional control of the application of negative resistance can be achieved by means of flow valve 70, which controls the rate of exhaust from the lower portion of the cylinder 30 and thus controls the speed at which the piston 32, and with it the crossbars 44, will move downwardly.

When the user has reached the desired downward movement of the barbell he will again appropriately actuate a switch 82 to cause the solenoid valve 80 to return to its initial position, the upper portion of the cylinder 30 will be vented to the atmosphere, and pressure will be exerted on the lower surface of the piston 32 raising the latter and with it the crossbars 44, thus removing the negative resistance that was previously applied to the barbell and leaving the barbell freely available for the next normal lifting stroke.

The switches 82 can accomplish this result in different ways. It is preferred that closing either switch 82 will cause the solenoid valve 80 to shift its status. In that case when the user closes either switch after lifting the bar negative resistance will be applied, when he next closes either switch the negative resistance will be withdrawn, and so on. Alternatively, the right-hand and left-hand switches 82 could be individually dedicated to a particular mode of operation, so that when, for example, the right-hand switch is activated negative resistance would be applied and when the left-hand switch is activated negative resistance would be withdrawn. Another alternative would be to have the closure of either switch cause negative resistance to be applied for so long as that switch remains closed, with negative resistance automatically being removed when both switches are released.

It will be noted that the user has complete control of the application of the negative resistance during the barbell lowering step, and if he feels overtaxed at any point he need only actuate a switch 82 and the negative resistance will terminate.

As an added safety feature, to protect the user in the event of forgetfulness or error, means may be provided for removing the negative resistance automatically when a predetermined lowered position of the crossbars 44 has been reached. As here disclosed a conventional reed switch 90 sensitive to magnetism may be mounted on the exterior of the cylinder 30 at an appropriate location, the switch being sensitive to the proximity of a magnet 92 mounted on the piston rod 33 and effective when sensing proximity of the magnet 92 to actuate the solenoid valve 80 so as to cause the crossbars 44 to be retracted. As a further safety factor, one or more of the uprights, such as the rear uprights 14, may be provided with a series of vertically spaced holes 94 adapted to selectively receive pins 96 which positively prevent the clamp bar 38 from moving any further down the uprights 14.

As a further feature of convenience and safety, the framework may include a pair of additional uprights 98 located laterally inside the uprights 12 and 14 and slightly to the front of the L-shaped connecting links 42. These Uprights 98 may be provided with one or more pairs of forwardly extending pins 100, those pins defining ledge-like supports adapted to receive the barbell bar 2. By making use of the pins 100 the barbell may be stored on the framework 6 when not in use, this being a matter of convenience, and the pins 100 also enable the user to stow the barbell 2 if, for example, his usual strength should weaken while exercising. All he needs do is lean back and press the bar 2 over a set of pins 100 and against the uprights 98 in order to relieve himself of its weight.

Thus the apparatus of the present invention provides for the application of an adjustable degree of negative resistance during the lifting exercises, with the time of initiation and the duration of the exertion of negative resistance being at all times under the control of the user. The means of exerting that control are conveniently positioned so as to be accessible to the user as he exercises. Safety features are provided to prevent against malfunction of the apparatus or errors or inattention on the part of the user. The apparatus, which may be in skeletal form, provides a housing in which the user may position himself in any desired posture. As here illustrated the user is seated, but the same apparatus may be used with the user standing or reclining, for example. Along similar lines, the functional parts of the apparatus are so mounted and connected that their relative positions can be varied to accommodate users of different statures. The apparatus is simple, sturdy, light in weight and inexpensive, and is made up of standardized components, such as uprights, bars, fluid pressure systems, solenoid valve systems and the like.

While but a single embodiment of the present invention has been here specifically disclosed, it will be appreciated that many variations can be made therein, all within the scope of the present invention as defined in the following claims.

I claim:

1. A negative resistance weightlifting apparatus comprising a support, an element mounted on said support to be movable up and down thereon, weight means adapted (a) to be grasped and lifted by the user and (b) to be operatively engaged with said element when said weight member is moved up, pressure means operatively connected to said element and effective when actuated to apply a force to said element in a downard direction, and actuating means for said pressure means comprising control means accessible to said user when lifting said weight means and effective when appropriately acted upon by said user to actuate said pressure means and thereby controllably produce a negative resistance as said weight member moves downward, in which said pressure means is also effective when appropriately actuated to apply a force to said element in an upward direction.

2. The apparatus of claim 1, in which said control means is on said weight means.

3. In the apparatus of claim 1, means for sensing when said element is moved downwardly to a lower limit position and for deactivating said pressure means in response to such sensing.

4. In the apparatus of claim 1, means for sensing when said element is moved downwardly to a lower limit position and for actuating said pressure means to cause it to apply force to said element in an upward direction in response to such sensing.

5. The apparatus of claim 3, in which said sensing means is adjustable so as to vary said lower limit position.

6. In the apparatus of claim 1, means on said support for positively limiting the downward movement of said element at a predetermined point of travel.

7. In the apparatus of claim 3, means on said support for positively limiting the downward movement of said element at a predetermined point of travel below said lower limit position associated with said sensing element.

8. The apparatus of claim 1, in which said weight means is located beneath and is unattached to said element.

9. The apparatus of claim 8, in which said weight means comprises a barbell.

10. The apparatus of claim 8, in which said weight means comprises a barbell and said control means is on the bar of said barbell.

11. The apparatus of claim 8, in which said control means is effective when not appropriately acted upon by said user to raise the said element to an elevated position.

12. The apparatus of claim 8, in which said control means is effective when not acted upon appropriately by said user to separate said element from said weight means and raise said element to an elevated position.

13. In the apparatus of claim 1, means for adjusting the speed at which said element is lifted to said elevated position when said control means causes it to so move.

14. In the apparatus of claim 1, means for adjusting the downward force which said pressure means exerts on said element.

15. In the apparatus of claim 1, means for adjusting the speed at which said pressure means causes said element to move downward.

16. The apparatus of claim 8, in which said support comprises front and rear upwardly extending parts spaced from one another and said element is slidable with respect to and comprises a length extending between said front and rear parts, thereby to be engaged by said weight means when said weight means is beneath said element and lifted by said user, said pressure means being mounted on said support and comprising a cylinder and piston, and means operatively connecting said piston to said element.

17. The apparatus of claim 16, in which said means operatively connecting said piston to said element comprises a member slidable over one of said front and rear parts.

18. The apparatus of claim 8, said support having exposed means thereon for supporting said weight means when the said weight means is not in use.

19. In the apparatus of claim 1, means for adjusting the vertical positioning of said pressure means on said support.

20. A negative resistance weightlifting apparatus comprising a support, an element mounted on said support to be movable up and down thereon, weight means adapted (a) to be grasped and lifted by the user and (b) to be operatively engaged with said element when said weight member is moved up, pressure means operatively connected to said element and effective when actuated to apply a force to said element in a downward direction, and actuating means for said pressure means comprising control means accessible to said user when lifting said weight means and effective when appropriately acted upon by said user to actuate said pressure means and thereby controllably produce a negative resistance as said weight member moves downward, and means for sensing when said element is moved downwardly to a lower limit position and for deactivating said pressure means in response to said sensing, in which said pressure means comprises a cylinder and a piston movable therein, and said sensing means senses the position of said piston in said cylinder.

21. The apparatus of claim 1, in which said pressure means comprises a pressure cylinder comprising a piston means operatively connected to said element for exerting a downward pressure on said element when said pressure cylinder is actuated.

22. In the apparatus of claim 21, means operatively connected to said pressure means for controllably varying the downward pressure exerted on said element.

23. In the apparatus of claim 21, means operatively connected to said pressure means for controlling the rate at which said piston means, when engaged with said element, causes said element to move downwardly.

24. A negative resistance weightlifting apparatus comprising a support, an element mounted on said support to be movable up and down thereon, weight means adapted (a) to be grasped and lifted by the user and (b) to be operatively engaged with said element when said weight member is moved up, pressure means operatively connected to said element and effective when actuated to apply a force to said element in a downward direction, and actuating means for said pressure means comprising control means accessible to said user when lifting said weight means and effective when appropriately acted upon by said user to actuate said pressure means and thereby controllably produce a negative resistance as said weight member moves downward, in which said support comprises two laterally spaced front uprights and two laterally spaced rear uprights spaced from said front uprights, the uprights being connected together to define a self-supporting structure, said element comprises a crossbar extending in a front-to-rear direction between said pairs of uprights and slidably mounted on at least some of said uprights, said pressure means comprising a cylinder mounted on said structure and having a piston extending therefrom, said piston being operatively connected to a clamp bar extending between and vertically sliding over at least one pair of uprights, said clamp bar being operatively connected to said crossbar.

25. The apparatus of claim 24, in which said weight means comprises a barbell adapted to be lifted by the user into engagement with said crossbar from below.

26. The apparatus of claim 24, in which said control means is mounted on said barbell.

27. In the apparatus of claim 23, means for sensing when said element is moved downwardly to a lower limit position and for deactivating said pressure means in response to such sensing.

28. The apparatus of claim 23, in which said control means is effective when not appropriately acted upon by said user to raise the said element to an elevated position.

29. In the apparatus of claim 23, means on said support for positively limiting the downward movement of said element at a predetermined point of travel.

* * * * *